United States Patent [19]

Kaiya et al.

[11] Patent Number: 5,049,066

[45] Date of Patent: Sep. 17, 1991

[54] BURNER FOR REDUCING NOX EMISSIONS

[75] Inventors: Kazuo Kaiya, Sakura; Toshimitsu Ido, Noda, both of Japan

[73] Assignee: Tokyo Gas Company Limited, Tokyo, Japan

[21] Appl. No.: 602,202

[22] Filed: Oct. 23, 1990

[30] Foreign Application Priority Data

Oct. 25, 1989 [JP] Japan ..... 1-277932

[51] Int. Cl.[5] ..... F23D 14/00

[52] U.S. Cl. ..... 431/352; 431/187; 431/354

[58] Field of Search ..... 431/352, 351, 350, 354, 431/187, 284

[56] References Cited

U.S. PATENT DOCUMENTS 2,604,937 7/1952 Nagel ..... 431/187

3,574,508 4/1971 Rothhaar ..... 431/351

*Primary Examiner*—Carroll B. Dority

*Attorney, Agent, or Firm*—Morrison Law Firm

[57] ABSTRACT

A burner for mixing and burning a gaseous fuel includes an inner pipe, carrying the gaseous fuel, and an outer pipe, carrying combustion air in the annular space between the inner and outer pipes. A cone-shaped horn is affixed to the end of the inner pipe. The horn extends near the inner surface of the outer pipe, leaving a narrow annular space therebetween. An alternating series of air jetting portions and blind portions around the periphery of the large end of the horn encourage the formation of mixing vortices as air passes through the air jetting portions. A plurality of radially directed fuel jetting openings in the inner pipe, upstream of the horn, inject gaseous fuel into the combustion air to form a lean air-fuel mixture. A plurality of jet openings at the end of the inner pipe, within the horn, direct gaseous fuel generally parallel to the diverging wall of the horn. Openings in the wall of the horn permit the entry of the lean mixture into the interior of the horn, where it mixes with the fuel flowing generally parallel to the wall of the horn. A spacial distribution, and a size distribution of the openings in the wall of the horn encourages the formation of a large number of generally independent flames, thereby encouraging stable combustion.

9 Claims, 4 Drawing Sheets

PRIOR ART

5049066

07 602202

BURNER FOR REDUCING NOX EMISSIONS

BACKGROUND OF THE INVENTION

1. Technical Field

This invention relates to a burner for reducing $NO_x$ emissions for use in a boiler or the like.

2. Prior Art

A combustion burner of the prior art includes an inner pipe, containing a flowing gaseous fuel within an outer pipe containing flowing combustion air. A perforated funnel-shaped horn diverges from the end of the inner pipe, and extends substantially all the way to the inner wall of the outer pipe. The combustion air is thus forced to pass through the perforations to mix with the gaseous fuel. Turbulence resulting from the passage of the air through the perforations, and the divergence of the horn results in substantial mixing of the fuel and air, whereby stable combustion is enabled.

Although the burner of the prior art produces stable combustion, it also produces high $NO_x$ emissions.

OBJECTS AND SUMMARY OF THE INVENTION

It is an object of the invention to provide a burner capable of reducing $NO_x$ emissions with a low manufacturing cost, and which does not require additional devices to reduce combustion temperature.

It is a further object of the invention to provide improved mixing of gaseous fuel and air in a burner in order to reduce $NO_x$ emissions.

It is a still further object of the invention to provide a burner wherein a large number of generally independent flames are maintained in order to achieve stable combustion.

It is a still further object of the invention to provide a burner wherein gaseous fuel is jetted into a stream of combustion air upstream of a perforated horn. The lean mixture thus produced is introduced into the interior of the horn where it mixes with additional gaseous fuel jetted generally parallel to the wall of the horn. Additional mixing takes place downstream of a gap between the perimeter of the horn and the inner wall of an outer pipe.

Briefly stated, the present invention provide a burner for mixing and burning a gaseous fuel. An inner pipe carries the gaseous fuel. An outer pipe carries combustion air in the annular space between the inner and outer pipes. A cone-shaped horn is affixed to the end of the inner pipe. The horn extends near the inner surface of the outer pipe, leaving a narrow annular space therebetween. An alternating series of air jetting portions and blind portions around the periphery of the large end of the horn encourage the formation of mixing vortices as air passes through the air jetting portions. A plurality of radially directed fuel jetting openings in the inner pipe, upstream of the horn, inject gaseous fuel into the combustion air to form a lean air-fuel mixture. A plurality of jet openings at the end of the inner pipe, within the horn, direct gaseous fuel generally parallel to the diverging wall of the horn. Openings in the wall of the horn permit the entry of the lean mixture into the interior of the horn, where it mixes with the fuel flowing generally parallel to the wall of the horn. The openings in the horn are concentrated in the vicinity of the narrow end, with few, if any, openings near the wide end of the horn. This spacial distribution, and a size distribution of the openings in the wall of the horn encourages the formation of a large number of generally independent flames, thereby encouraging stable rich combustion concentrated near the narrow end of the horn. The lean mixture, jetting past the large end of the horn, supports lean combustion in that area, generally independently of the rich combustion taking place near the narrow end of the horn. This prevents localized high-temperature combustion and thus permits efficient reduction of $NO_x$ emissions.

According to an embodiment of the invention, there is provided a burner comprising: an inner pipe, an outer pipe concentrically disposed about said inner pipe, thereby forming an annular space between said inner pipe and said outer pipe, a diverging horn affixed to an end of said inner pipe, a first plurality of openings in said horn, a second plurality of openings in said inner pipe, upstream of said horn, said second plurality of openings being directed radially outward into said annular space, a third plurality of openings in an end of said inner pipe within said horn, said third plurality of openings being directed generally parallel to a wall of said horn, and an alternating plurality of jetting portions and blind portions in an outer perimeter of said horn.

According to a feature of the invention, there is provided a burner comprising: an inner pipe, an outer pipe concentrically disposed about said inner pipe and forming an annular space therebetween, means for jetting a gaseous fuel from said inner pipe generally radially into said annular space, a horn at an end of said inner pipe, a gap between said horn and an inner surface of said outer pipe, means for permitting a gas from said annular space to pass into an interior of said horn, first means for jetting said gaseous fuel into said interior of said horn in a direction generally parallel to a wall of said horn, and second means for jetting a remainder of said gas through said gap.

Part of the gas flowing in the interior of the inner pipe is jetted radially from a plurality of second gas jetting openings formed upon the inner pipe and then well mixed with a combustion air flowing in the interior of the outer pipe. Part of this lean mixture is introduced into the interior of the horn through the plurality of openings where it is well mixed with the gas jetted along the internal wall from the plurality of first gas jetting openings. This produces rich stable combustion.

The other part of the lean mixture is jetted from the plurality of mixed air jetting portions formed in the gap and to produce further combustion. Such a combination of combustion brings about a substantial reduction in $NO_x$ emissions.

The above, and other objects, features and advantages of the present invention will become apparent from the following description read in conjunction with the accompanying drawings, in which like reference numerals designate the same elements.

BRIEF DESCRIPTION OF THE ACCOMPANYING DRAWINGS

DETAILED DESCRIPTION OF PREFERRED EMBODIMENTS

Figure 1:
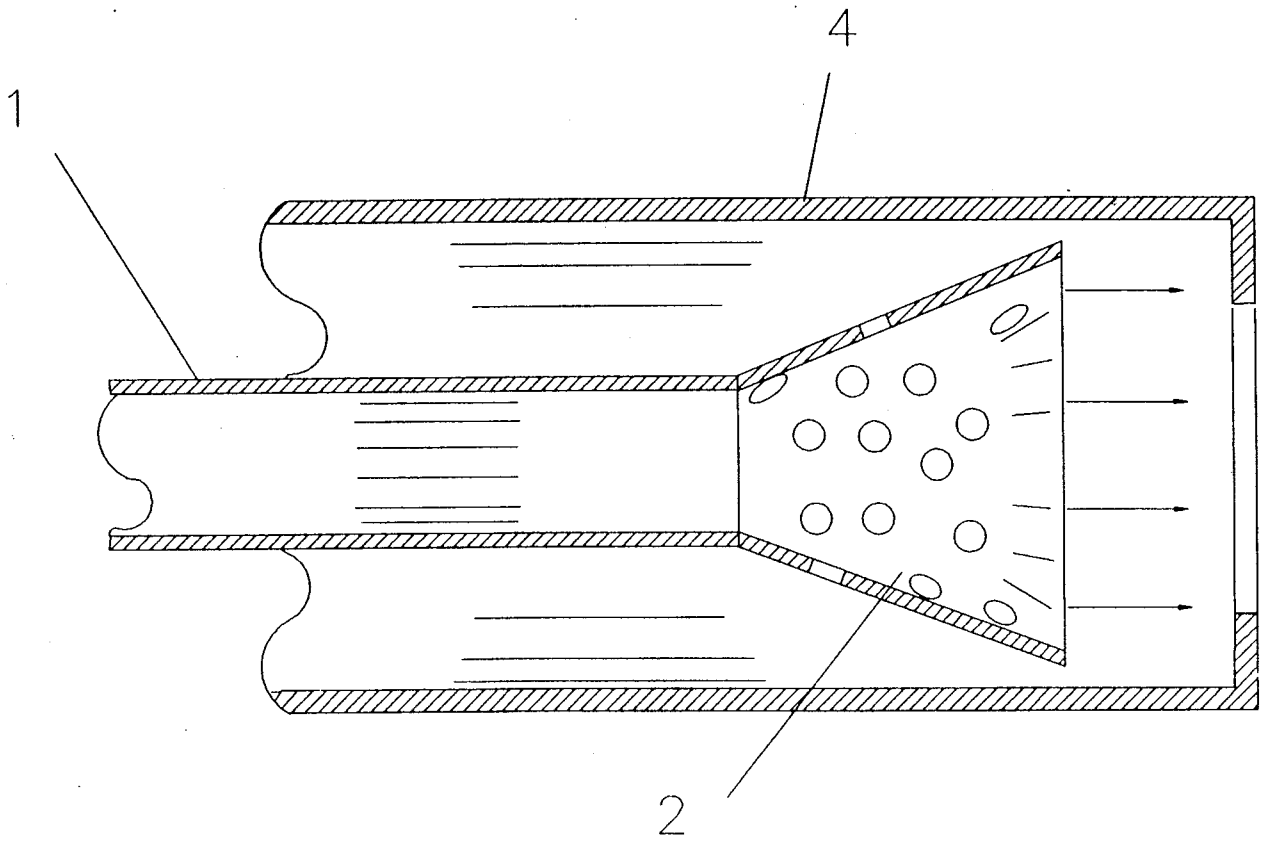
FIG. 1 is a schematic section view of a conventional burner.

Referring to FIG. 1, a typical conventional burner for use in a boiler or the like, includes an inner pipe 1 within an outer pipe 4. A perforated horn 2, having a plurality of openings, is affixed to an end of inner pipe 1.

This conventional burner provides stable combustion, but it also produces a high level nitrogen oxide($NO_x$) emissions of, for example, 75 to 100 ppm ($O_2$=0%). Compliance with emission standards requires the addition of devices for recirculating exhaust gas or injecting water in the burner to reduce temperature, thereby reducing $NO_x$ emission. Such additional devices increase the cost of the boiler. For example, the manufacturing cost of a small boiler for industrial use may be increased by 20 to 30%.

Figure 2:
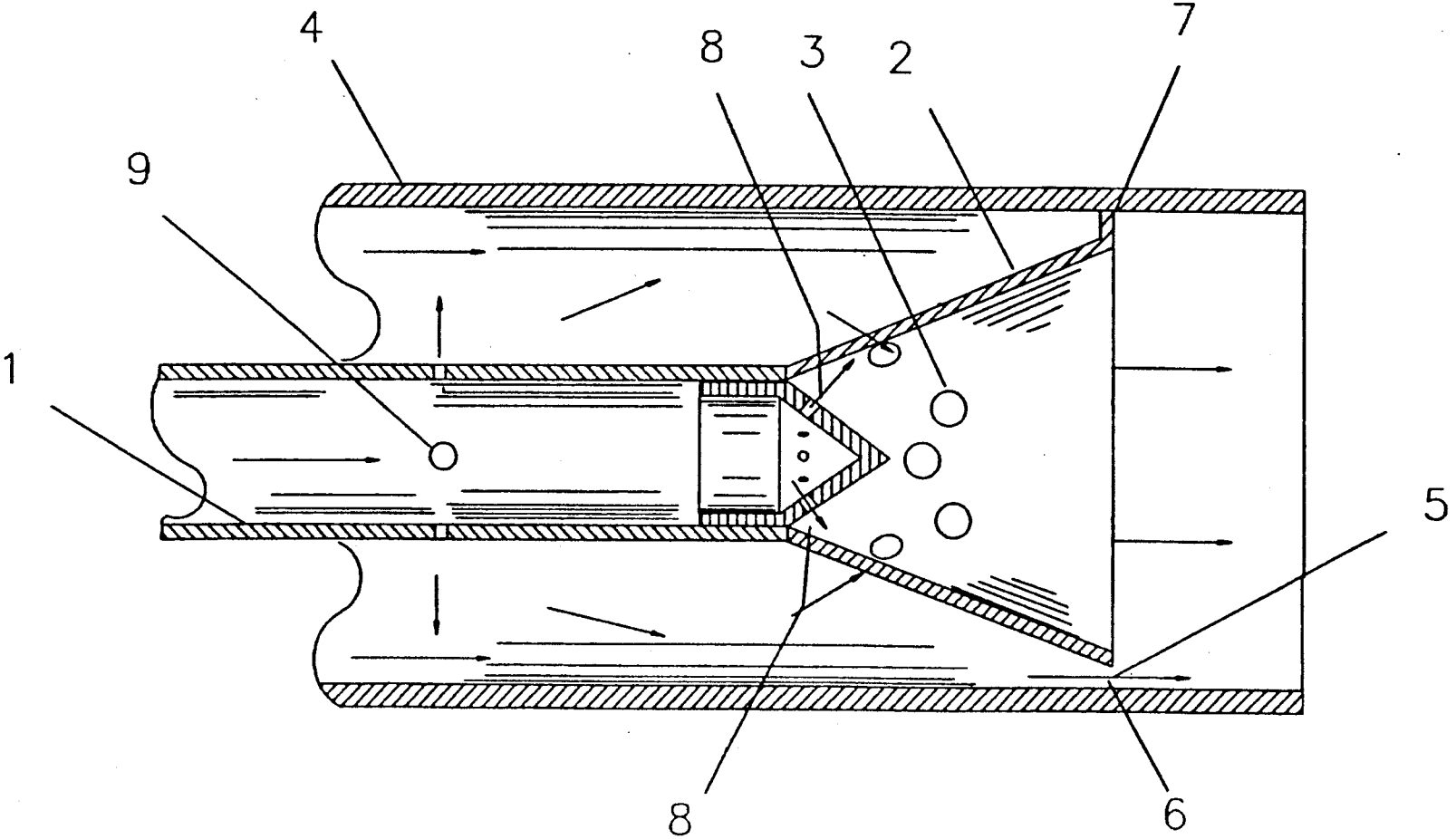
FIG. 2 is a longitudinal section view of an embodiment of a burner according to an embodiment of the present invention.

Referring now to FIG. 2, a burner according to an embodiment of the present invention includes an outer pipe 4 and an inner pipe 1. A horn 2 is affixed to an end of inner pipe 1. Near its small end, horn 2 includes a plurality of openings 3 permitting the passage of a lean mixture of gas and air therethrough. The remainder of horn 2 is solid, without perforations.

An outer diameter of the larger end of horn 2 is slightly smaller than the inner diameter of outer pipe 4, thereby forming an annular gap 5 between outer pipe 4 and horn 2.

Figure 3:
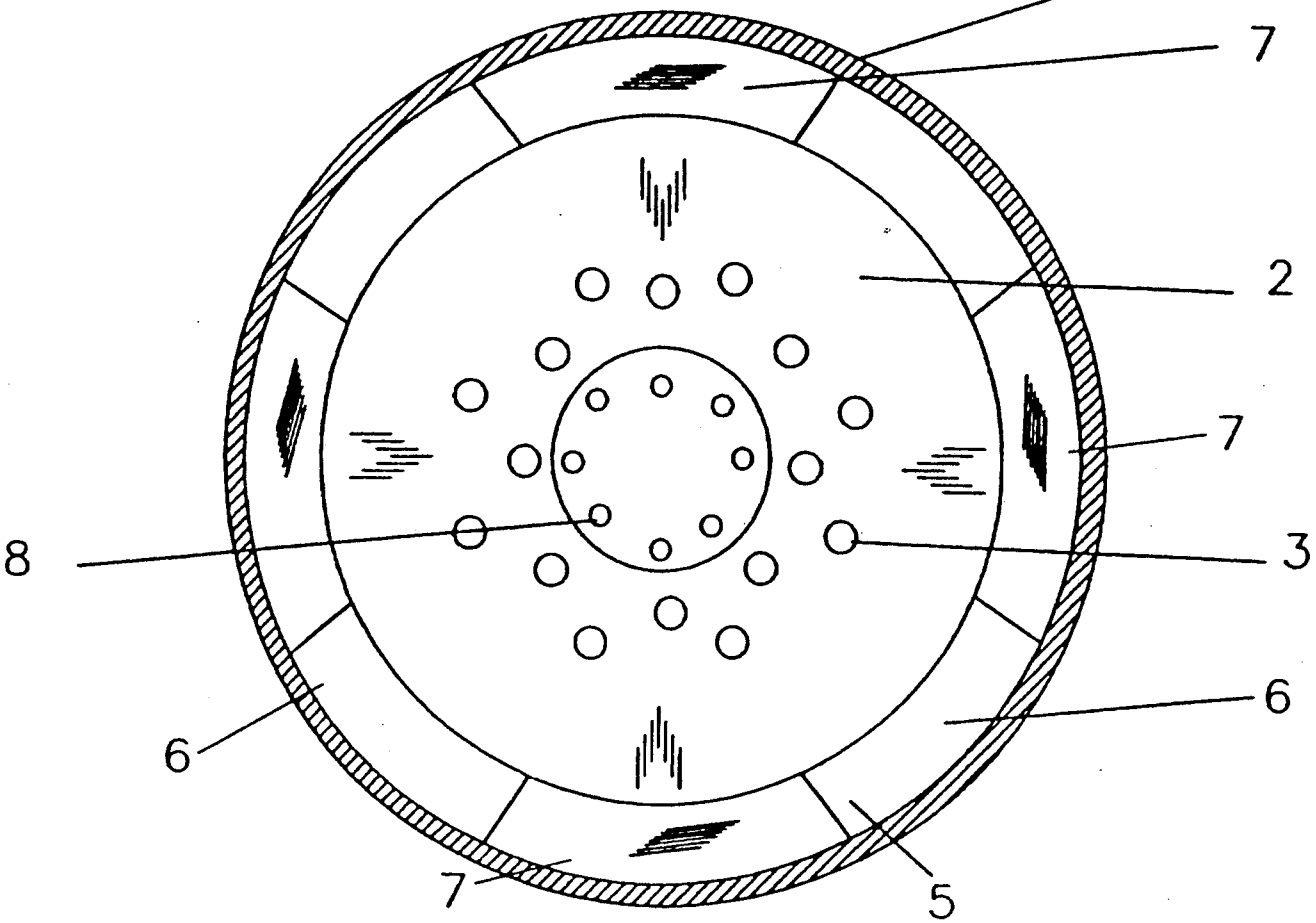
FIG. 3 is a front view of the embodiment in FIG. 2.

Referring now to FIG. 3, a plurality of mixed air jetting portions 6 and a plurality of blind portions 7 alternate around annular gap 5.

A plurality of openings 8 are formed on a front surface of inner pipe 1. A first flow of gaseous fuel is jetted through openings 8 into the interior of horn 2. Openings 8 are directed generally parallel to the wall of horn 2, whereby the first flow of gaseous fuel tends to flow parallel to the wall of horn 2.

Referring again to FIG. 2, a plurality of openings 9 jet a second flow of gaseous fuel into an annular space between inner pipe 1 and outer pipe 4, upstream of horn 2. It will be recognized that openings 9 jet gaseous fuel in a generally radial direction.

The amount of gaseous fuel jetted through openings 9 produce a lean mixture of fuel and air in the annular space.

If the openings 3 were distributed uniformly over the surface of horn 2, the flame would spread throughout horn 2, including the larger end. This could enable localized high temperature combustion. This prevents achievement of a dense, rich combustion in one location, and lean combustion in another location. Consequently, it is impossible to obtain efficient reduction in $NO_x$ emissions.

The openings 3 may be distributed on horn 2 in an irregular array, and their sizes may differ over a substantial range. In particular, the openings 3 are distributed in the vicinity of the narrow end of horn 2, with few, or none, in the vicinity of the larger end. This enables the desired dense, rich, combustion in the vicinity of the narrow end of horn 2, while permitting separate lean combustion in, and just downstream of annular gap 5.

When a gaseous fuel flows in inner pipe 1 and air flows in outer pipe 4, part of the gaseous fuel flowing within inner pipe 1 is jetted radially from second gas jetting openings 9 and is well mixed with the air flowing within outer pipe 4 to form a lean mixture. Part of the lean mixture is introduced into the interior of horn 2 through openings 3, and is then well mixed with the gas jetted along the internal wall of horn 2 from first gas jetting openings 8. As a result, the gas mixes well and produces a rich and dense combustion.

If the plurality of openings 3 are disposed in an irregular manner or their sizes are different, a large number of different independent flames are produced simultaneously. This tends to establish a constant, stable combustion.

The remainder of the lean mixture is jetted through the plurality of mixed air jetting portions 6 at the large perimeter of horn 2. The air passing through jetting portions 6 form vortices in the proximity of blind portions 7 where enrichment of the lean mixture with additional gaseous fuel within horn 2 permits further combustion to occur.

As discussed above, the present invention enables combustion within horn 2 relatively independently of combustion within the outer periphery of horn 2.

Since a large number of genrally independent flames are generated, localized high temperature combustion is avoided. The limiting of temperatures reduces the production of $NO_x$ emissions.

Figure 4:
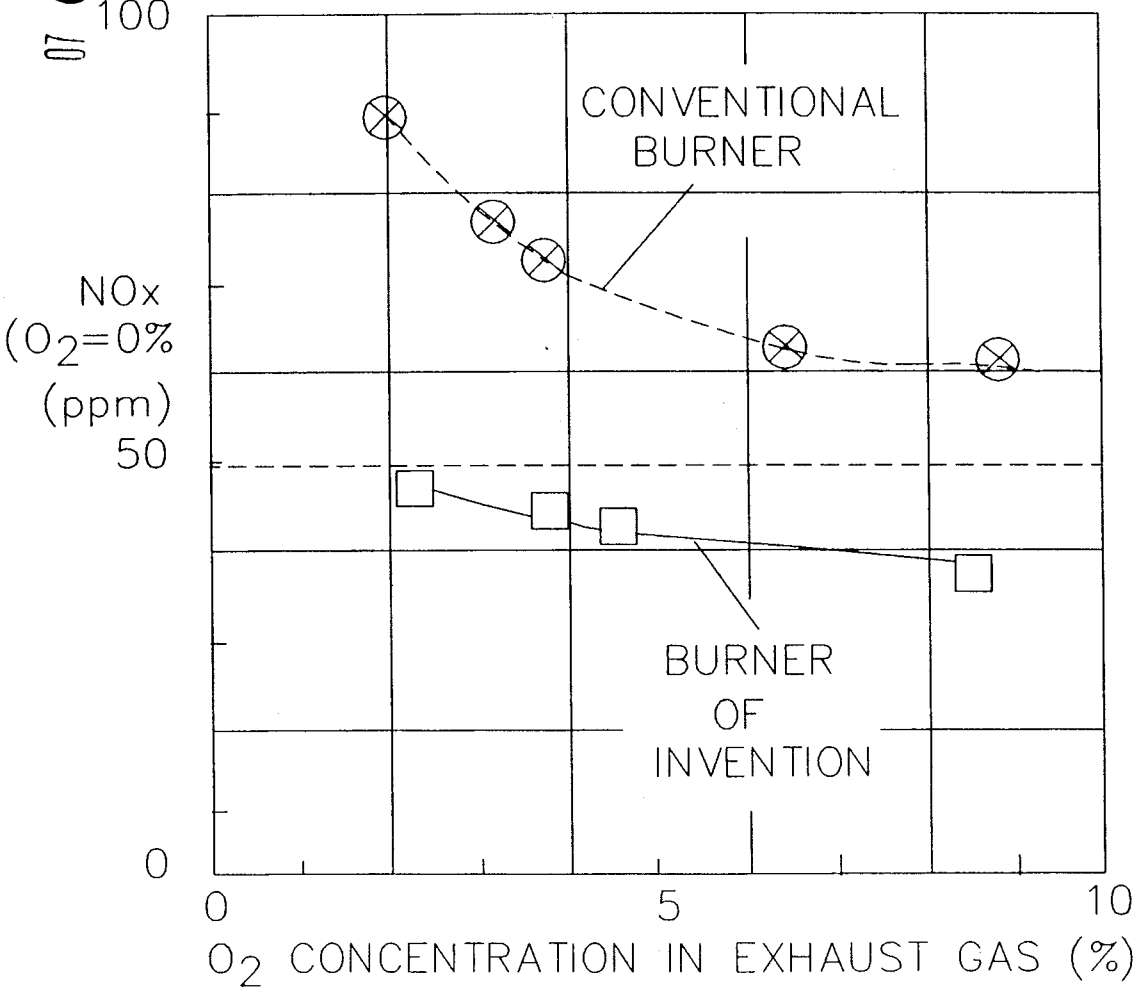
FIG. 4 is a graph of $NO_x$ concentration in exhaust gases of a conventional burner as well as of a burner according to this invention.

FIG. 4 shows a comparative graph showing $NO_x$ emission from a burner according to the present invention and a conventional burner. As clearly shown in FIG. 4, whereas $NO_x$ emision of the burner of the present invention is limited to no more than 50 ppm ($O_2$=0%), the $NO_x$ emission of a conventional burner is much higher i.e. 90 to 60 ppm. It is clear that the burner of the present invention greatly reduces $NO_x$ emission compared to the conventional burner.

The $NO_x$ reduction by the present invention is achieved without the addition of exhaust gas recirculation or water jet devices. In other words, the reduction of $NO_x$ emissions is achieved by the unique construction of the burner itself. The present burner lends itself to compact construction, and low burner cost.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A burner comprising:

an inner pipe;

an outer pipe concentrically disposed about said inner pipe, thereby forming an annular space between said inner pipe and said outer pipe;

a diverging horn affixed to an end of said inner pipe;

a first plurality of openings in said horn;

a second plurality of openings in said inner pipe, upstream of said horn;

said second plurality of openings being directed radially outward into said annular space;

a third plurality of openings in an end of said inner pipe within said horn;

said third plurality of openings being directed generally parallel to a wall of said horn; and an alternating plurality of jetting portions and blind portions in an outer perimeter of said horn.

2. Apparatus according to claim 1, wherein said outer perimeter is slightly smaller than an inner diameter of said outer pipe, whereby an annular gap is formed therebetween.

3. Apparatus according to claim 1, wherein said first plurality of openings is unevenly distributed on said horn.

4. Apparatus according to claim 1, wherein said first plurality of openings have different sizes.

5. Apparatus according to claim 1, wherein said third plurality of openings are disposed in a vicinity of a narrow end of said horn.

6. Apparatus according to claim 5, wherein said first plurality of openings are completely absent in a vicinity of a wide end of said horn.

7. A burner comprising:

an inner pipe;

an outer pipe concentrically disposed about said inner pipe and forming an annular space therebetween;

means for jetting a gaseous fuel from said inner pipe generally radially into said annular space;

a horn at an end of said inner pipe;

a gap between said horn and an inner surface of said outer pipe;

means for permitting a gas from said annular space to pass into an interior of said horn;

first means for jetting said gaseous fuel into said interior of said horn in a direction generally parallel to a wall of said horn; and second means for jetting gas through an end wall of said horn.

8. Apparatus according to claim 7, wherein said end wall of said horn includes:

an alternating series of jetting openings and blind portions about a perimeter of said horn; and said jetting openings and blind portions being effective to form vortices downstream of said blind portions, whereby mixing of said gas with said gaseous fuel in enhanced, and stable combustion is aided.

9. A burner comprising:

an outer pipe;

an inner pipe generally concentrically disposed within said outer pipe;

a generally conical horn affixed to an end of said inner pipe;

a gap between a wide end of said horn and an inner surface of said outer pipe;

means for producing a lean mixture of a fuel and air upstream of said horn;

means for permitting said lean mixture to pass through said gap;

a plurality of openings in said horn;

said plurality of openings being disposed in a vicinity of a narrow end of said horn;

said plurality of openings being absent in a vicinity of a wide end of said horn;

said plurality of openings permitting said lean mixture to pass therethrough; and means for jetting a fuel from an end of said inner pipe within said horn, and generally parallel to a diverging inner surface of said horn.

* * * * *